US006856778B2

(12) United States Patent
Vejtasa et al.

(10) Patent No.: US 6,856,778 B2
(45) Date of Patent: Feb. 15, 2005

(54) SYSTEM AND METHOD FOR RECYCLING HYDROCARBON-BASED CARRIER LIQUID

(75) Inventors: David S. Vejtasa, Mountain View, CA (US); Christopher A. Schantz, Redwood City, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/219,100

(22) Filed: Aug. 15, 2002

(65) Prior Publication Data

US 2004/0033086 A1 Feb. 19, 2004

(51) Int. Cl.[7] ..... G03G 15/10; G03G 21/10

(52) U.S. Cl. ..... 399/237; 399/359

(58) Field of Search ..... 399/237, 250, 399/358, 359

(56) References Cited

U.S. PATENT DOCUMENTS

| | | | | |
|---|---|---|---|---|
| 3,767,300 A | * | 10/1973 | Brown et al. | 399/250 |
| 3,907,695 A | | 9/1975 | Amidon | |
| 3,955,533 A | * | 5/1976 | Smith et al. | 399/358 |
| 4,799,542 A | | 1/1989 | Day | |
| 4,870,462 A | | 9/1989 | Day | |
| 5,121,164 A | | 6/1992 | Landa | |
| 5,557,376 A | | 9/1996 | Landa et al. | |
| 5,557,378 A | * | 9/1996 | Abreu et al. | |
| 5,592,269 A | | 1/1997 | Younes et al. | |
| 5,737,674 A | | 4/1998 | Venkatesan et al. | |
| 5,848,322 A | * | 12/1998 | Chen et al. | |
| 5,933,689 A | * | 8/1999 | Kim | 399/237 |
| 5,950,054 A | * | 9/1999 | Kim | 399/237 |
| 5,970,273 A | | 10/1999 | Zenk | |
| 5,987,273 A | * | 11/1999 | Yamamoto | |
| 6,011,943 A | * | 1/2000 | Kim | 399/237 |
| 6,535,700 B1 | * | 3/2003 | Caruthers | |
| 2001/0017997 A1 | * | 8/2001 | Saitoh | 399/250 |
| 2003/0016962 A1 | * | 1/2003 | Teraoka et al. | 399/237 |

FOREIGN PATENT DOCUMENTS

| | | | | |
|---|---|---|---|---|
| EP | 0575698 | | 12/1993 | |
| JP | 11065292 A | * | 3/1999 | G03G/15/10 |

* cited by examiner

*Primary Examiner*—Susan Lee

(57) ABSTRACT

A system and method for recycling used hydrocarbon-based carrier liquid removes contaminants from the used carrier liquid and monitors an electrical property of the output carrier liquid so that the carrier liquid can be reused in a predefined application, such as an electrostatic imaging process. The system and method may be integrated into an electrostatic imaging machine.

25 Claims, 4 Drawing Sheets

SYSTEM AND METHOD FOR RECYCLING HYDROCARBON-BASED CARRIER LIQUID

FIELD OF THE INVENTION

The invention relates generally to recycling, and more particularly to a system and method for recycling carrier liquid.

BACKGROUND OF THE INVENTION

In an electrostatic imaging process, a copy of an original image is produced by forming a toner image from a latent electrostatic image, which is then transferred to a target substrate, such as paper. The latent electrostatic image is generated by initially charging a photoconductor to create a uniform electrostatic charge of a particular polarity over the surface of the photoconductor. As an example, the photoconductor can be charged by exposing the surface of the photoconductor to a charge corona. The uniformly charged surface of the photoconductor is then patterned by selectively directing a modulated beam of light, such as a beam of laser light, to form the latent electrostatic image. Using charged toner particles having opposite polarity of the photoconductor surface, the latent electrostatic image is developed into the toner image by applying the charged toner particles to the photoconductor surface, which selectively adhere to the photoconductor surface according to the latent electrostatic image.

There are two distinct types of electrostatic imaging machines. The first type of electrostatic imaging machines uses dry toner to form toner images. The second type of electrostatic imaging machines uses liquid toner to form the toner images. Liquid toner generally includes toner particles and charge director compounds that are dispersed in a dielectric hydrocarbon-based carrier liquid, such as hydrocarbon solvents sold under the name of ISOPAR, which is a trademark of the Exxon Corporation. In some electrostatic imaging machines, the liquid toner is formed within the machine by mixing concentrated toner solvent, charge director compounds and dielectric hydrocarbon-based carrier liquid. In these electrostatic imaging machines, after the liquid toner is used, the used carrier liquid is extracted from remaining liquid toner by evaporating the carrier liquid and then condensing the evaporated carrier liquid. The used carrier liquid is then collected in a receptacle. The used carrier liquid cannot be reused in an electrostatic imaging process, so the carrier liquid is discarded. When additional carrier liquid is needed, new carrier liquid is introduced to the machine to produce more liquid toner.

A concern with the above-described electrostatic imaging machines is that the machines continuously use carrier liquid, and consequently, continuously produce used carrier liquid. Used carrier liquid, such as ISOPAR, is hazardous waste and must be disposed in a proper manner. The disposal of used carrier liquid adds significant cost and time to the operation of the electrostatic imaging machines. Furthermore, since the used carrier liquid is treated as hazardous waste, the operation of the electrostatic imaging machines contributes to the environmental problem of hazardous waste disposal.

In view of these concerns, there is a need for a system and method to reduce or eliminate hazardous waste in the form of used carrier liquid produced by electrostatic imaging machines and to reduce operator interventions.

SUMMARY OF THE INVENTION

A system and method for recycling used hydrocarbon-based carrier liquid removes contaminants in the form of water and solid particulates from the used carrier liquid and monitors an electrical property of the output carrier liquid so that the carrier liquid can be reused in an electrostatic imaging process. In the exemplary embodiment, the system and method is integrated into an electrostatic imaging machine, which greatly reduces or eliminates, depending on operating efficiency, the need to manually remove used carrier liquid and to refill the machine with new carrier liquid. In addition, since the system and method allows the electrostatic imaging machine to reuse the carrier liquid, there is no need to dispose the used carrier liquid as hazardous waste or to refill the machine with new carrier liquid. Consequently, the system and method reduces the cost of operating the electrostatic imaging machine and reduces operator interventions.

A system for recycling used hydrocarbon-based carrier liquid in accordance with the invention includes a contaminant removal device and a monitoring device. The contaminant removal device is configured to remove contaminants in the used hydrocarbon-based carrier liquid to produce an output hydrocarbon-based carrier liquid. The monitoring device is configured to monitor an electrical property, e.g., the resistivity, of the output hydrocarbon-based carrier liquid to determine the suitability of the output hydrocarbon-based carrier liquid for predefined application, such as electrostatic imaging.

The system may further include an electrostatic imaging system that uses liquid toner having hydrocarbon-based carrier liquid. The electrostatic imaging system is configured to extract the used hydrocarbon-based carrier liquid from used liquid toner to provide the used hydrocarbon-based carrier liquid to the contaminant removal device.

A method of recycling used hydrocarbon-based carrier liquid includes receiving the used hydrocarbon-based carrier liquid, removing contaminants in the used hydrocarbon-based carrier liquid to produce an output hydrocarbon-based carrier liquid, and monitoring an electrical property, e.g., the resistivity, of the output hydrocarbon-based carrier liquid to determine the suitability of the output hydrocarbon-based carrier liquid for predefined application, such as electrostatic imaging.

Other aspects and advantages of the present invention will become apparent from the following detailed description, taken in conjunction with the accompanying drawings, illustrated by way of example of the principles of the invention.

DETAILED DESCRIPTION

Figure 1:
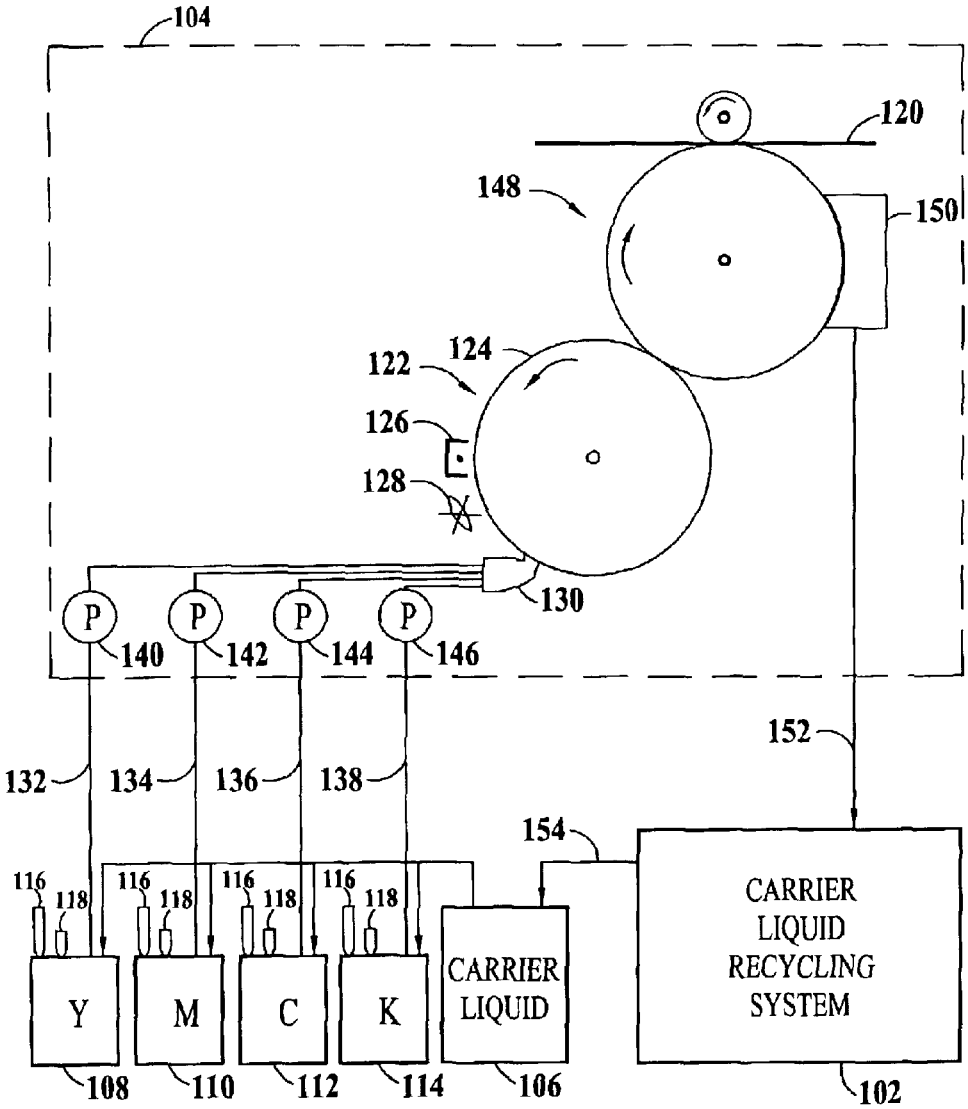
FIG. 1 is a diagram of an electrostatic imaging machine in accordance with the present invention.

With reference to FIG. 1, an electrostatic imaging machine 100 in accordance with the invention is shown. The electrostatic imaging machine includes a carrier liquid recycling system 102 to remove contaminants in the used carrier liquid so that the carrier liquid can be reused in the electrostatic imaging operation of the machine. The recycling process performed by the carrier liquid recycling system does not require manual intervention. Thus, the electrostatic imaging machine is much easier to use than conventional electrostatic imaging machines that require manual removal of used carrier liquid and manual refill of new carrier liquid into the machine. The carrier liquid recycling system also eliminates the need to dispose the used carrier liquid as hazardous waste. Furthermore, the carrier liquid recycling system virtually eliminates the need to manually introduce new carrier liquid into the machine. Consequently, the carrier liquid recycling system provides cost and time savings to the operation of the electrostatic imaging machine, as well as eliminating the production of hazardous waste.

As shown in FIG. 1, the electrostatic imaging machine 100 includes an imaging system 104 and the carrier liquid recycling system 102. The electrostatic imaging machine further includes a carrier liquid receptacle 106 and liquid toner receptacles 108, 110, 112 and 114. The carrier liquid receptacle is used to hold new carrier liquid or recycled carrier liquid from the carrier liquid recycling system. The carrier liquid may be any hydrocarbon-based liquid having a resistivity value suitable for electrostatic imaging process. In the exemplary embodiment, the carrier liquid is a hydrocarbon-based liquid commercially available under the name ISOPAR, which is a trademark of the Exxon Corporation. The liquid toner receptacles are used to hold individual color liquid toners. As indicated in FIG. 1, the liquid toner receptacles may be used to hold liquid toners for yellow (Y), magenta (M), cyan (C) and black (K). However, the liquid toner receptacles may be used to hold liquid toners of different colors. Each of the different color liquid toners is a mixture of concentrated toner, charge director compounds, and carrier liquid. Thus, is each liquid toner receptacle is connected to a corresponding concentrated toner container 116 and a charge director container 118 to receive the respective concentrated toner and charge director compounds. The liquid toner receptacles are also connected to the carrier liquid receptacle to receive the carrier liquid. Each liquid toner receptacles is further connected to the imaging system to supply the color liquid toners for electrostatic imaging.

The imaging system 104 of the electrostatic imaging machine 100 operates to print a replicate image of an original image onto a target substrate 120, e.g., a printing paper, using the liquid toners from the liquid toner receptacles 108–114. As a result of the electrostatic imaging operation, the imaging system produces used carrier liquid, which is extracted from remaining liquid toners. The imaging system is illustrated and described herein as an example. The imaging machine may utilize any type of imaging system that utilizes one or more liquid toners and produces used carrier liquid as a byproduct of an electrostatic imaging process.

As shown in FIG. 1, the imaging system 104 includes a drum 122 having a photoconductor surface 124. The photoconductor surface of the drum is used to initially generate a latent electrostatic image and then to generate a toner image. The imaging system further includes a photoconductor charging device 126, an optical imaging device 128, and a multi-color toner spray assembly 130, which are operatively associated with the drum 122 to generate latent electrostatic and toner images. The photoconductor charging device operates to uniformly charge the photoconductor surface of the drum with a charge of a particular polarity. As an example, the photoconductor charging device may be a corona discharge device. The optical imaging device operates to create a latent electrostatic image on the charged photoconductor surface by selectively discharging portions of the charged photoconductor surface according to the original image to be replicated. As an example, the optical imaging device may be a laser scanner, an ionographic imaging device or an optical projection device. The multi-color toner spray assembly operates to selectively provide different color liquid toners from the liquid toner receptacles 108-114 to the photoconductor surface. Thus, the multi-color toner spray assembly is connected to the liquid toner receptacles via conduits 132, 134, 136 and 138. Along these conduits, there are pumps 140, 142, 144 and 146 to pump the different color liquid toners to the multi-color toner spray assembly through the respective conduits.

The imaging system 104 further includes an intermediate transfer member 148 positioned to engage the photoconductor surface 124 of the drum 122, as illustrated in FIG. 1. The intermediate transfer member operates to transfer the toner image on the photoconductor surface of the drum to the target substrate 120. Depending on the imaging system, the intermediate transfer member may sequentially transfer toner images of different colors to the target substrate to form a color image on the target substrate. That is, each toner image of a particular color is generated and transferred to the target substrate through the intermediate transfer member. Alternatively, the intermediate transfer member may collectively transfer toner images of different colors to the target substrate as a color composite toner image. In this configuration, each toner image of a particular color is sequentially transferred to the intermediate transfer member to form a color composite toner image on the intermediate transfer member. The color composite toner image is then transferred to the target substrate to form a color image on the target substrate.

The imaging system 104 also includes a carrier liquid removal device 150, which is operatively associated with the intermediate transfer member 148. The carrier liquid removal device operates to extract the used carrier liquid from the liquid toners that were used to form the toner images. The carrier liquid is extracted by evaporating the carrier liquid from remaining liquid toner on the surface of the intermediate transfer member, and then, condensing the evaporated carrier liquid to collect the used carrier liquid. Consequently, the carrier liquid removal device may include a fan (not shown) and a condenser (not shown) to evaporate and condense the carrier liquid. The collected used carrier liquid is transmitted to the carrier liquid recycling system 102 through a conduit 152.

The imaging system 104 may include additional components that are commonly found in conventional electrostatic imaging machines. However, these additional components are not described herein so as to not obscure aspects of the invention.

The carrier liquid recycling system 102 of the electrostatic imaging machine 100 operates to remove contaminants from the used carrier liquid so that the used carrier liquid can be recycled, and consequently, reused in the imaging system 104. Thus, there is no need to dispose the used carrier liquid, which is treated as hazardous waste. Furthermore, since the used carrier liquid is reused, there is no need to introduce new carrier liquid into the electrostatic imaging machine, except to periodically replenish a minute operating loss of carrier liquid. The carrier liquid recycling system is connected to the imaging system through the conduit 152 to receive used carrier liquid. In addition, the carrier liquid recycling system is connected to the carrier liquid receptacle 106 through a conduit 154 to replenish the supply of carrier liquid in the carrier liquid receptacle.

Figure 2:
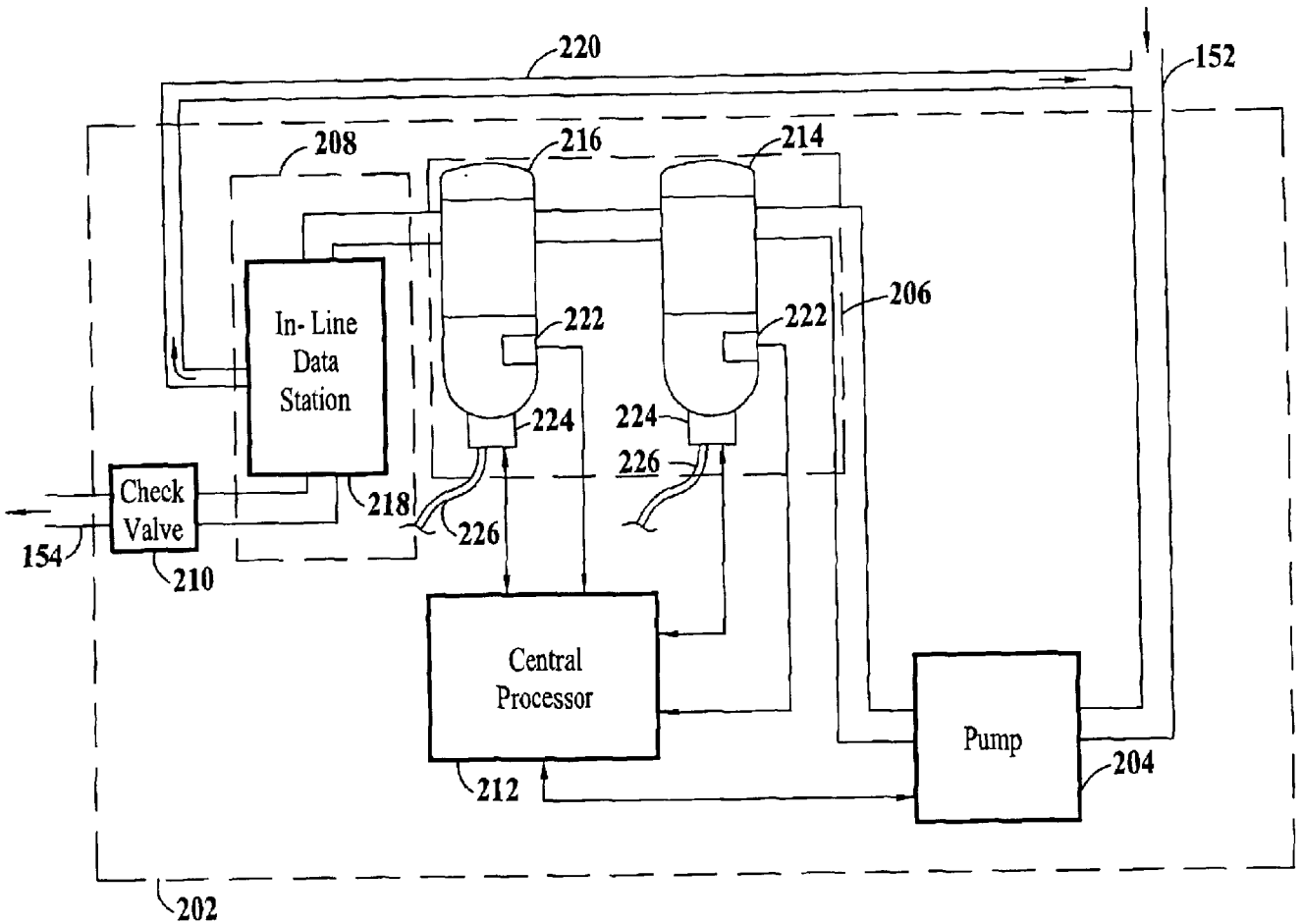
FIG. 2 is a diagram of a carrier liquid recycling system included in the electrostatic imaging machine of FIG. 1 in accordance with a first embodiment of the invention.

In FIG. 2, a carrier liquid recycling system 202 in accordance with a first embodiment of the invention is shown. The carrier liquid recycling system includes a pump 204, a contaminant removal device 206, a monitoring device 208 and a check valve 210, which are connected in series. The carrier liquid recycling system further includes a central processor 212 to monitor various operations of the system.

The pump 204 of the carrier liquid recycling system 202 is connected to the conduit 152 to receive the used carrier liquid from the carrier liquid removal device 150 of the imaging system 104. The pump operates to push the received used carrier liquid through the carrier liquid recycling system. The contaminant removal device 206 operates to remove contaminants in the form of water and solid particulates from the used carrier liquid to output a reusable carrier liquid. In the exemplary implementation, the contaminant removal device includes a primary oil/water separating-and-filtering device 214 and a secondary oil/water separating-and-filtering device 216. The secondary oil/water separating-and-filtering device 208 is an optional component of the contaminant removal device. However, the contaminant removal device may include more than two oil/water separating-and-filtering devices. The primary and secondary oil/water separating-and-filtering devices are described in more detail below.

The monitoring device 208 of the carrier liquid recycling system 202 operates to measure the resistivity of the output carrier liquid. In the exemplary implementation, the monitoring device includes an in-line data station 218 that contains circuitry to measure the resistivity of the output carrier liquid. In one configuration, the in-line data station includes a shut-off valve (not shown) to stop the flow of carrier liquid when the measured resistivity falls below a predefined threshold so that the output carrier liquid is ensured to be suitable for electrostatic imaging process. In an alternative configuration, the in-line data station includes a valve (not shown) to selectively route the carrier liquid to the conduit 154 as output carrier liquid or to the conduit 152 through a feedback conduit 220 to further process the carrier liquid when the measured resistivity falls below the predefined threshold to ensure that the output carrier liquid is suitable for electrostatic imaging process. The check valve 210 operates to ensure that the carrier recycling system is under positive pressure, eliminating excess air in the carrier liquid. Consequently, the influence of air on the resistivity reading by the in-line data station is minimized. The check valve is connected to the conduit 154, which leads to the carrier liquid receptacle 106 to replenish the carrier liquid used in the imaging system.

As stated above, in the exemplary implementation, the contaminant removal device 206 includes the primary and secondary oil/water separating-and-filtering devices 214 and 216, which operate to remove water and solid particulates from the used carrier liquid. Each of the oil/water separating-and-filtering devices may be a device that uses a three-stage process, such as the diesel fuel filter/separator (model 500FGSS) sold by the Racor Division of the Parker Hannifin Corporation. The first stage involves centrifuging the input carrier liquid, which sends water droplets and large particulates to the lower part of the device. The second stage involves coalescing the carrier liquid so that remaining water is formed into water droplets and drops to the lower part of the device. The third stage involves filtering the carrier liquid using a micron-level filter to remove smaller particulates from the carrier liquid. However, other types of devices may be used for the primary and secondary oil/water separating-and-filtering devices that can remove water and solid particulates from the input carrier liquid so that the resistivity of the output carrier liquid is suitable for electrostatic imaging process, which ranges approximately from $1\times10^{11}$ to $1\times10^{13}$ ohm*cm.

Each of the primary and secondary oil/water separating-and-filtering devices 214 and 216 includes a sensor 222 for detecting the removed water level at the bottom of the respective device. In addition, each oil/water separating-and-filtering device includes a release valve 224 for releasing the removed water and solid particulates from the bottom of the device through a drain tube 226. The sensors and release valves are electrically connected to the central processor 212, which controls the release valves based on the detected water levels at the respective oil/water separating-and-filtering devices. The central processor is also connected to the pump 204 to control the flow of carrier liquid through the recycling system 202. The central processor monitors the sensors and the release valves of the oil/water separating-and-filtering devices and the pump to ensure that the output carrier liquid does not include the removed water and solid particulates. The central processor may be a part of a computer system to exclusively control the carrier liquid recycling system. Alternatively, the central processor may be a part of a computer system to control the entire electrostatic imaging machine 100.

Figure 3:
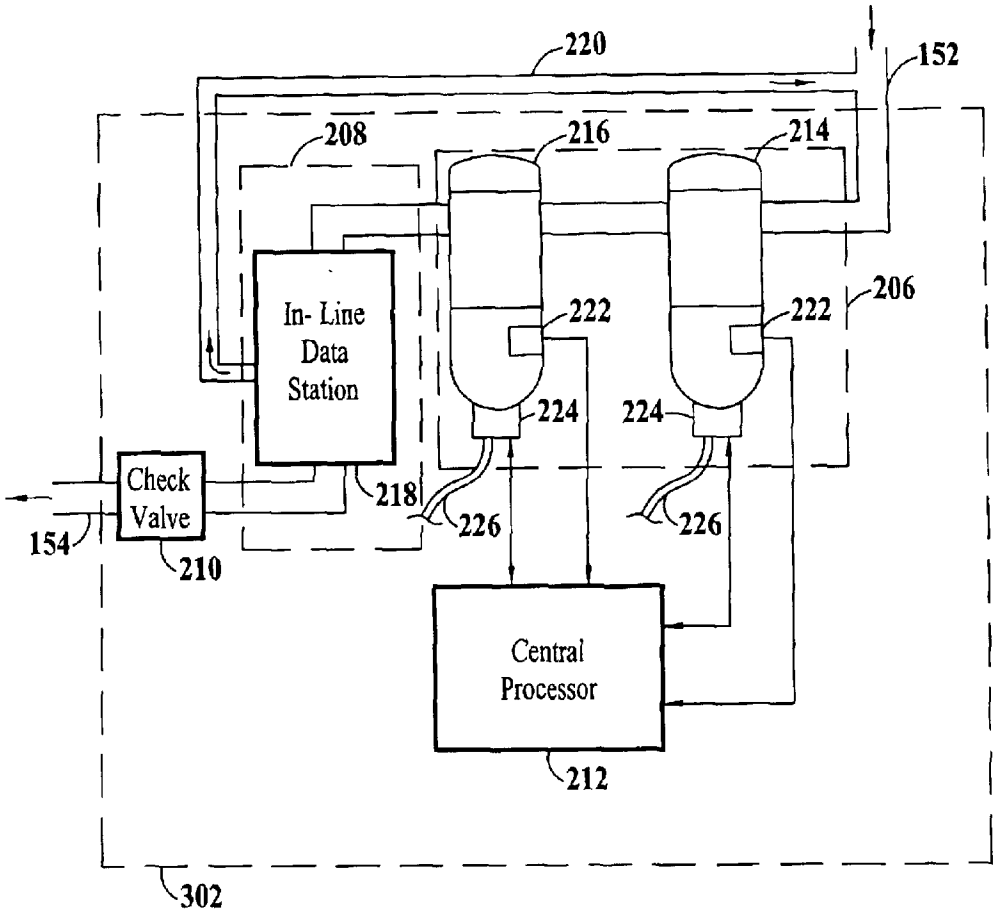
FIG. 3 is a diagram of a carrier liquid recycling system included in the electrostatic imaging machine of FIG. 1 in accordance with a second embodiment of the invention.

Turning now to FIG. 3, a carrier liquid recycling system 302 in accordance with a second embodiment of the invention is shown. The carrier liquid recycling system 302 includes the same components of the carrier liquid recycling system 202, except for the pump 204. Thus, the reference numerals of FIG. 2 are used in FIG. 3 to indicate the common components of the recycling systems. In this embodiment, the potential energy derived from the placement of the carrier liquid removal device 150 of the imaging system 104 with respect to the carrier liquid recycling system is used in lieu of the pump to push the carrier liquid through the recycling system. That is, the carrier liquid recycling system is placed at a position of lower potential energy than the carrier liquid removal of the imaging system to push the carrier liquid through the carrier liquid recycling system. The overall operation of the carrier liquid recycling system 302 to remove water and solid particulates from used carrier liquid is virtually identical to the carrier liquid recycling system 202. However, since there is no pump, the central processor 212 only monitors the sensors 222 and release valves 224 of the primary and secondary oil/water separating-and-filtering devices 214 and 216 to ensure that the output carrier liquid does not include the removed water and solid particulates. In an alternative configuration, the central processor may be replaced with a dedicated set of electronics for each oil/water separating-and-filtering device to monitor the removed water level and to control the respective release valve based on the water level. Thus, the need for a computer system and a pump is eliminated in the carrier liquid recycling system 302. As a result, the carrier liquid recycling system 302 requires less space, uses less energy to operate, and costs less to manufacture than the carrier liquid recycling system 202.

Although the carrier liquid recycling systems 202 and 302 have been described herein as being a part of the electrostatic imaging machine 100, the carrier liquid recycling systems may be configured as stand-alone systems. That is, the carrier liquid recycling systems may be physically separated from the electrostatic imaging machine. In these embodiments, the carrier liquid recycling systems includes an input container (not shown) to supply the used carrier liquid and an output container (not shown) to store the processed carrier liquid. Furthermore, in these embodiments, the carrier liquid recycling systems may not include the feedback conduit 220 from the in-line data station 218 to the conduit 152. Consequently, when the measured resistivity of the carrier liquid is below the predefined threshold, the carrier liquid is further processed by simply transferring the carrier liquid from the output container back to the input container.

Figure 4:
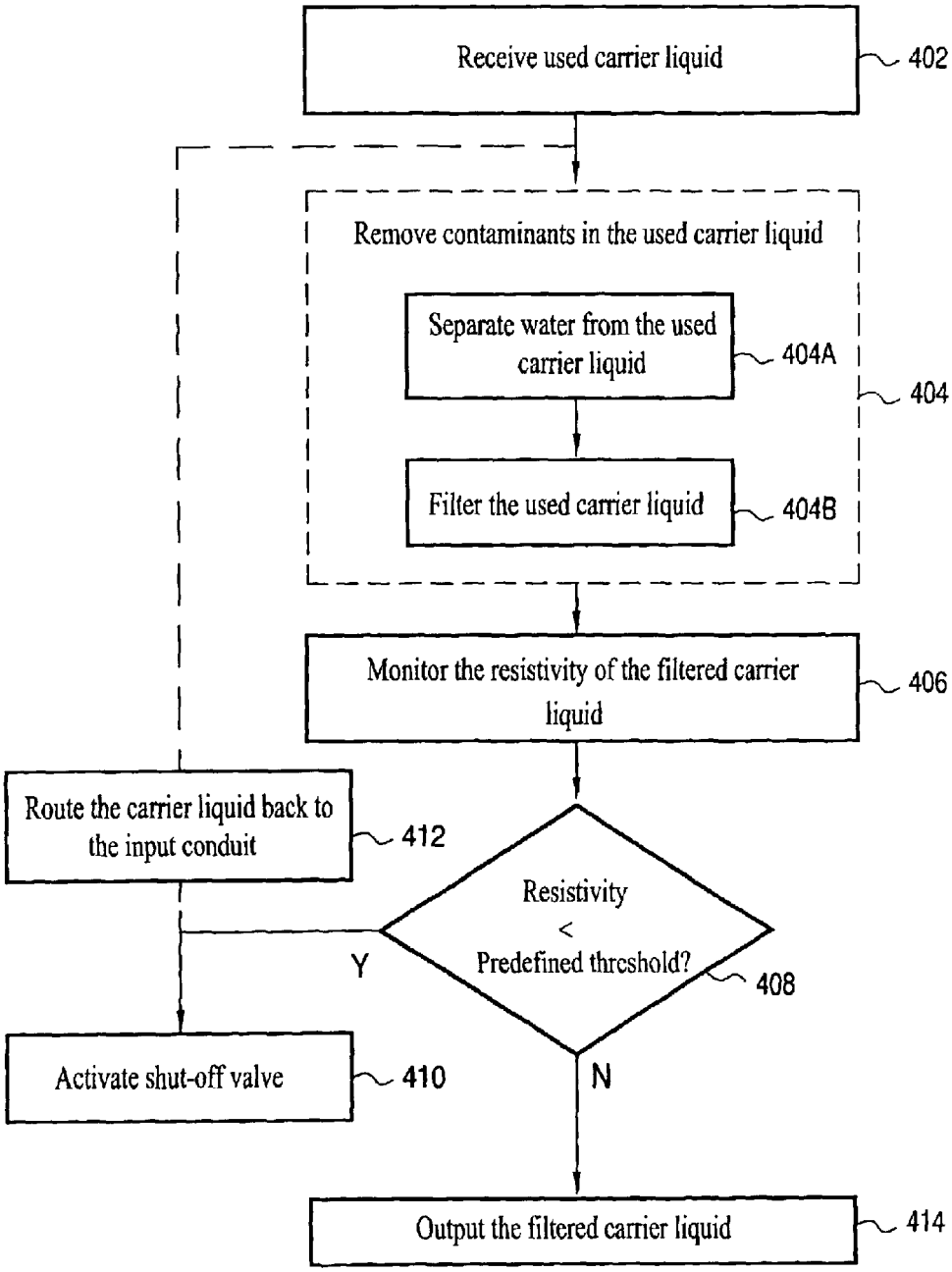
FIG. 4 is a process flow diagram of a method of recycling used carrier liquid in accordance with the present invention.

A method for recycling used carrier liquid in accordance with the invention is described with reference to the process flow diagram of FIG. 4. At block 402, the used carrier liquid is received through an input conduit of a carrier liquid recycling system. In the exemplary embodiment, the used carrier liquid is received directly from a carrier liquid removal device of an imaging system. Next, at block 404, contaminants in the used carrier liquid are removed to produce a "filtered" carrier liquid, which may be reused in an electrostatic imaging process. In the exemplary embodiment, contaminants that are removed from the used carrier liquid include water and solid particulates. Thus, in the exemplary embodiment, the removal of contaminants includes separating water from the used carrier liquid, at sub-block, 404A, and filtering the used carrier liquid to remove the solid particulates from the used carrier liquid, at sub-block 404B. The separating of water from the used carrier liquid may be achieved by centrifuging and coalescing the used carrier liquid. Next, at block 406, the resistivity of the filtered carrier liquid is monitored. At block 408, a determination is made whether the resistivity of the filtered carrier liquid is below a predefined threshold. If so, in one configuration, at block 410, a shut-off valve of the carrier liquid recycling system is activated so that the filtered carrier liquid is not used for electrostatic imaging process. In an alternative configuration, at block 412, the filtered carrier liquid is routed back to the input conduit of the carrier liquid recycling system to further process the carrier liquid at blocks 404–408. However, if the resistivity is not below the predefined threshold, then the filtered carrier liquid is outputted to a receptacle to be reused in an electrostatic imaging machine, at block 414.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A method of recycling used hydrocarbon-based carrier liquid comprising:

receiving said used hydrocarbon-based carrier liquid;

removing contaminants in said used hydrocarbon-based carrier liquid to produce an output hydrocarbon-based carrier liquid; and monitoring an electrical properly of said output hydrocarbon-based carrier liquid to determine the suitability of said output hydrocarbon-based carrier liquid for predefined application.

2. The method of claim 1 wherein said receiving of said used hydrocarbon-based carrier liquid 1includes receiving said used hydrocarbon-based carrier liquid directly from an electrostatic imaging system.

3. The method of claim 1 wherein said removing of said contaminants includes separating water from said used hydrocarbon-based carrier liquid and filtering solid particulates in said used hydrocarbon-based carrier liquid.

4. The method of claim 3 wherein said separating of said water from said used hydrocarbon-based carrier liquid includes centrifuging and coalescing said used hydrocarbon-based carrier liquid.

5. The method of claim 1 wherein said monitoring of said electrical property of said output hydrocarbon-based carrier liquid includes monitoring resistivity of said output hydrocarbon-based carrier liquid to determine the suitability of said output hydrocarbon-based carrier liquid for use in an electrostatic imaging process.

6. The method of claim 1 wherein said receiving of said used hydrocarbon-based carrier liquid includes receiving said used hydrocarbon-based carrier liquid at a position of lower potential energy than the position from where said used hydrocarbon-based carrier liquid originated.

7. The method of claim 1 further comprising maintaining a positive pressure on said output hydrocarbon-based carrier liquid to reduce the amount of air introduced into said output hydrocarbon-based carrier liquid.

8. The method of claim 1 further comprising repeating said removing of said contaminants and said monitoring of said electrical property for said output hydrocarbon-based carrier liquid when said electrical property is below a predetermined threshold.

9. A system for recycling used hydrocarbon-based carrier liquid comprising:

a contaminant removal device having an input to receive said used hydrocarbon-based carrier liquid, said contaminant removal device being configured to remove contaminants in said used hydrocarbon-based carrier liquid to produce an output hydrocarbon-based carrier liquid; and a monitoring device configured to monitor an electrical property of said output hydrocarbon-based carrier liquid to determine the suitability of said output hydrocarbon-based carrier liquid for predefined application.

10. The system of claim 9 further comprising an electrostatic imaging system that uses liquid toner having hydrocarbon-based carrier liquid, said electrostatic imaging system being configured to extract said used hydrocarbon-based carrier liquid from used liquid toner, said electrostatic imaging system being connected to said input of said contaminant removal device to provide said used hydrocarbon-based carrier liquid.

11. The system claim 10 wherein said contaminant removal device is located at a position of lower potential energy than an originating location of said electrostatic imaging system from where said used hydrocarbon-based carrier liquid originated to supply pressure to drive said used hydrocarbon-based carrier liquid through said contaminant removal device.

12. The system of claim 9 wherein said contaminant removal device is configured to separate water from said used hydrocarbon-based carrier liquid and filter solid particulates in said used hydrocarbon-based carrier liquid.

13. The system of claim 12 wherein said contaminant removal device is configured to centrifuge and coalesce said used hydrocarbon-based carrier liquid to separate said water from said used hydrocarbon-based carrier liquid.

14. The system claim 13 wherein said contaminant removal device includes at least one diesel fuel filter and water separator.

15. The system of claim 9 wherein said monitoring device is configured to monitor resistivity of said output hydrocarbon-based carrier liquid to determine the suitability of said output hydrocarbon-based carrier liquid for use in an electrostatic imaging process.

16. The system of claim 9 further comprising a check valve operatively associated with said monitoring device to maintain a positive pressure on said output hydrocarbon-based carrier liquid.

17. The system claim 9 further comprising a feedback conduit from said monitoring device to said contaminant removal device to selectively route said output hydrocarbon-based carrier liquid back to said contaminant removal device for further processing when said electrical property of said output hydrocarbon-based carrier liquid is below a predefined threshold.

18. An electrostatic imaging apparatus comprising:

an electrostatic imaging system configured to generate images on target substrate using liquid toner that includes carrier liquid said electrostatic imaging system being configured to extract used carrier liquid from used liquid toner; and a contaminant removal device having an input to receive said used carrier liquid from said electrostatic imaging system, said contaminant removal device being configured to remove contaminants in said used carrier liquid to produce an output carrier liquid to be reused in said electrostatic imaging system, said contaminant removal device including at least one diesel fuel filter and water separator.

19. The apparatus or claim 18 wherein said contaminant removal device is configured to separate water from said used carrier liquid and filter solid particulates in said used carrier liquid.

20. The apparatus of claim 19 wherein said contaminant removal device is configured to centrifuge and coalesce said used carrier liquid to separate said water from said used carrier liquid.

21. The apparatus or 18 further comprising a monitoring device configured to monitor resistivity of said output carrier liquid to determine the suitability of said output carrier liquid for use in an electrostatic imaging process.

22. An electrostatic imaging apparatus comprising:

an electrostatic imaging system configured to generate images on target substrate using liquid toner that includes carrier liquid, said electrostatic imaging system being configured to extract used carrier liquid from used liquid toner; and means for removing contaminants in said used carrier liquid to produce an output carrier liquid, said removing means being configured so receive said used carrier liquid from said electrostatic imaging system and to reintroduce said output carrier liquid into said electrostatic imaging system, said removing means including at least one diesel fuel filter and water separator.

23. The apparatus of claim 22 wherein said removing means includes means for separating water from said used carrier liquid and means for filtering solid particulates in said used carrier liquid.

24. The apparatus of claim 23, wherein said separating means is configured to centrifuge and coalesce said used carrier liquid to separate said water from said used carrier liquid.

25. The apparatus of claim 22 further comprising a means for monitoring resistivity of said output carrier liquid to determine the suitability of said output carrier liquid for use in an electrostatic imaging process.

* * * * *